US005758477A

United States Patent [19]

Wilson, Jr. et al.

[11] Patent Number: 5,758,477

[45] Date of Patent: Jun. 2, 1998

[54] INTERFACE DEVICE FOR PACKAGING EQUIPMENT

[76] Inventors: Ollie B. Wilson, Jr., 609 Camp St., Riverdale, Ga. 30274; Robert F. Polkinghorne, 2457 Greenfield La., Jonesboro, Ga. 30236; James S. Smith, 6428 Woodstone Way, Morrow, Ga. 30260

[21] Appl. No.: 891,896

[22] Filed: Jul. 14, 1997

[51] Int. Cl.[6] ..... B65B 57/20

[52] U.S. Cl. ..... 53/500; 53/147; 53/251; 53/260; 53/493

[58] Field of Search ..... 53/500, 501, 495, 53/493, 498, 260, 255, 2.51, 2.5, 147, 443

[56] References Cited

U.S. PATENT DOCUMENTS

| | | | |
|---|---|---|---|
| 3,450,249 | 6/1969 | Poll | 53/500 |
| 3,766,706 | 10/1973 | Graham | 53/124 D |
| 3,815,763 | 6/1974 | Bilco et al. | 214/16 R |
| 4,031,999 | 6/1977 | Wagner et al. | 53/500 X |
| 4,159,761 | 7/1979 | Egee et al. | 53/500 X |
| 5,170,610 | 12/1992 | Tisma | 53/447 |
| 5,428,938 | 7/1995 | Davis | 53/284.7 |

*Primary Examiner*—James F. Coan
*Attorney, Agent, or Firm*—Kenneth S. Watkins, Jr.

[57] ABSTRACT

An interface device for packaging equipment comprises three bins arranged vertically and separated by gates located at the bottom of each bin. An infeed unit or conveyor feeds product into the receiver bin. A product counter in a logic unit counts the product fed into the receiver bin. The logic unit cycles the counted product into the buffer and discharge bins, respectively to provide an accumulator function. The logic unit cycles the discharge gate upon output of a flight sensor on the outfeed unit to deliver the counted product on the desired location of the outfeed unit. The device allows temporary differences between product flow rates between the infeed unit and the outfeed unit. No connections to the control system of the outfeed unit is required.

4 Claims, 5 Drawing Sheets

INTERFACE DEVICE FOR PACKAGING EQUIPMENT

BACKGROUND OF THE INVENTION

The present invention relates to packaging equipment and, more particularly, to interface devices which accept a product stream from an infeed unit and discharge a second product stream compatible with an outfeed unit.

A common problem faced in the packaging and food processing industries is to connect an infeed unit such as a conveyor to an outfeed packaging or processing unit. For example, the infeed unit may be a continuous conveyor of product and the outfeed unit may be a batch processing unit. The infeed and outfeed units may have separate control systems which are not compatible. The infeed and outfeed rates may vary slightly with product variances, and with mechanical or electrical variances. Theses variances may lead to product backing up or overflowing components of either unit and in some cases may result in costly shutdowns of the packaging line.

Another common need when interfacing infeed and outfeed units is to provide groups of counted product for delivery to the outfeed unit. This is especially useful feature in packaging industries where the final package may contain a predetermined amount of product being delivered by the infeed unit.

U.S. Pat. No. 3,815,763 discloses a grinder feeding system. The system comprises a magazine located above a grinder pocket. A conveyor system located above the grinder loads logs into the magazine. The magazine comprises a plurality of loading boxes located one above another, each having a gate for permitting one box to discharge to another box below.

U.S. Pat. No. 5,170,610 discloses a portable loader which receives product on an asynchronous and on-demand basis and delivers product on a time basis coordinated with the operation of an automatic packaging machine. The loader comprises two bins in order to accommodate the timing of the packaging machine. The loader requires signals from the packaging machine which indicate the mode of operations of the packaging machine.

None of the disclosed art provides an interface unit which has the flexibility required to be used with any infeed and outfeed units and allows sufficient independence of the control systems of the units.

OBJECTS AND SUMMARY OF THE INVENTION

Therefore an object of the present invention is to provide an interface device for packaging equipment which allows connection of an infeed unit with an outfeed unit having product flow rates which temporarily differ from each other.

A further object of the present invention is to provide an interface device for packaging equipment which allows connection of an infeed unit with an outfeed unit with different control units.

A further object of the present invention is to provide an interface device for packaging equipment which allows connection of an infeed unit with an outfeed unit without electrical connections to the control unit of the outfeed unit.

A further object of the present invention is to provide an interface device for packaging equipment which allows connection of an infeed unit with an outfeed unit where the outfeed unit operates independently from the infeed unit.

A further object of the present invention is to provide an interface device for packaging equipment which has separate receiver, buffer, and discharge sections to allow accumulation of product while maintaining synchronous product feed to the outfeed unit.

A further object of the present invention is to provide an interface device for packaging equipment which counts the incoming product and delivers the counted product to the outfeed unit in predetermined product groups.

The interface device comprises three bins aligned vertically and separated by moveable gates which are normally closed. The top bin is a receiver bin and comprises a receiver gate at the bottom of the bin. A buffer bin is located below the receiver bin and comprises a buffer gate at the bottom of the buffer bin. A discharge bin is located below the buffer gate and comprises a discharge gate on the bottom of the discharge bin.

Product from an infeed unit such as an infeed conveyor is fed to the fist bin. A product sensor detects the product between the infeed conveyor and the first bin. A counter in a logic unit of the device counts the product. When the desired product count is reached and the buffer bin is empty, the receiver gate is cycled by the logic unit and the product falls into the buffer bin and the product counter is reset. If the discharge bin is empty, the logic unit cycles the buffer gate and the counted product falls into the discharge bin. A flight sensor on the outfeed unit is connected to the logic unit. The logic unit cycles the discharge gate to deliver the counted product into the desired flight of the outfeed unit.

Use of three bins allows the interface unit to perform multiple functions. The unit delivers product received individually as counted groups of product. The unit acts as a buffer, in that the unit adjusts for temporary product rate differences between the infeed unit and the outfeed unit. A flight detector and the logic unit allow discharge of the counted product at a precise location on the outfeed unit.

The interface unit allows independent operation of the outfeed unit. No connections are required between the outfeed unit control system and the interface unit. Connections may be made between the logic unit of the interface unit and the infeed unit to stop the infeed unit upon backup of the product in the interface unit which would occur upon a shutdown of the outfeed unit.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of an interface device for packaging equipment which counts and indexes an incoming product stream to an outgoing product stream.

Figure 1:
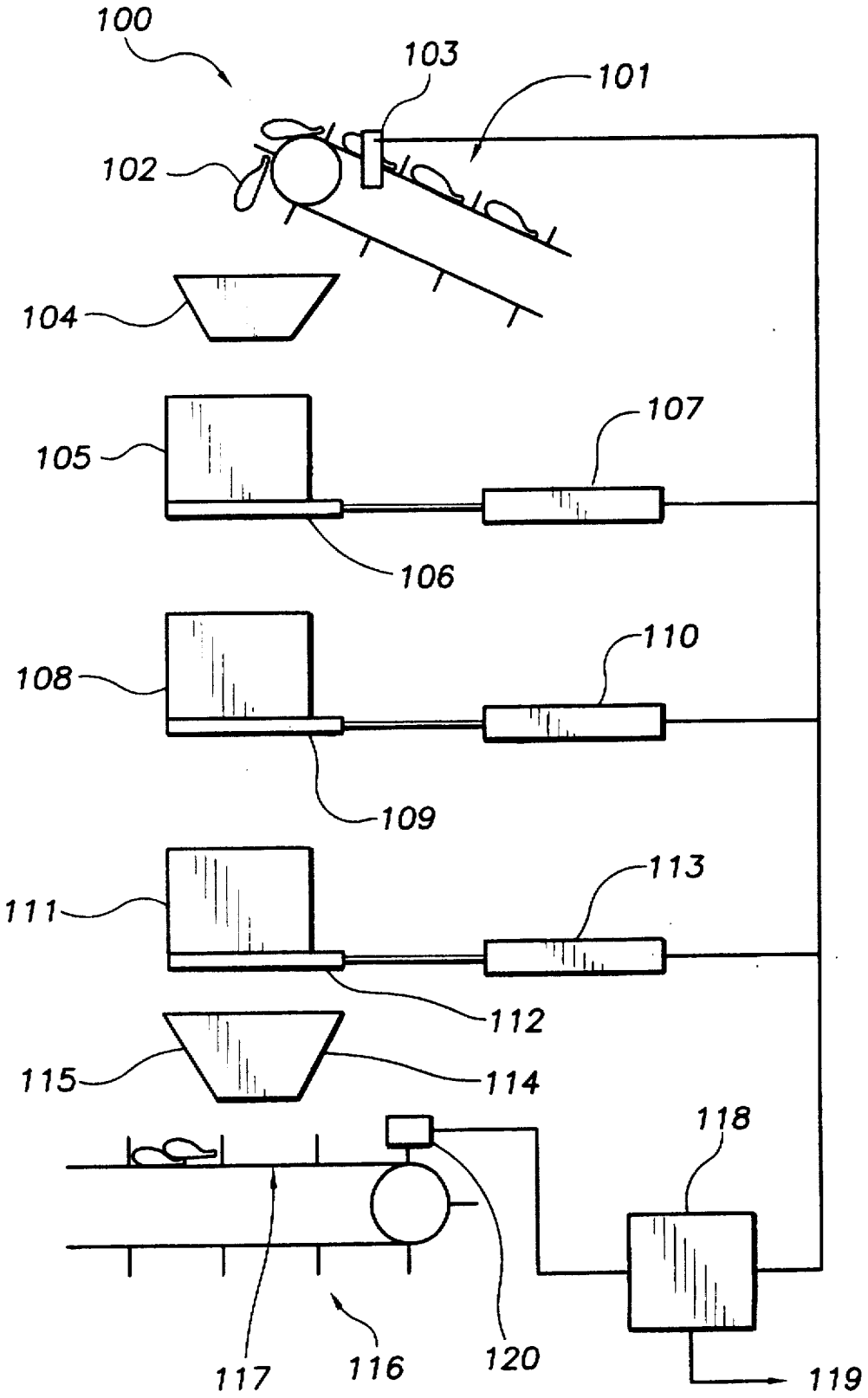
FIG. 1 is a schematic diagram of embodiment 100 of the interface unit showing an infeed conveyor, a receiver bin and gate, a buffer bin and gate, and a discharge bin and gate, an outfeed conveyor and a logic unit controlling actuators for the gates.

FIG. 1 is a schematic diagram of embodiment 100 of an interface device for counting product 102 of infeed unit or conveyor 101 and discharging the counted product 115 synchronously with the movement of the product carrying elements or flights 117 of outfeed unit or conveyor 116.

Receiver hopper 104 receives product 102 from infeed conveyor 101 and directs the product to receiver bin 105. Logic unit 118 receives pulses from product sensor 103 located on infeed conveyor 101. A counter (not shown) in logic unit 118 counts product sensed by product sensor 103. Output from logic unit 118 causes actuator 107 of receiver gate 106 to cycle receiver gate 106 upon counting a predetermined number of products as sensed by product sensor 103.

Product sensor 103 may be located between infeed unit 101, inclusive and receiver gate 106. For the purposes of this disclosure, the term between infeed unit 101, inclusive and receiver gate 106 is defined as on infeed unit 101 or the product path between infeed unit 101 and receiver gate 106, including receiver bin 105.

Buffer bin 108, located under receiver gate 106 receives the counted product from receiver bin 105 by gravity upon cycling of receiver gate 106. Logic unit 118 cycles buffer gate 109 with buffer gate actuator 110 upon receiving counted product from receiver bin 105 if discharge bin 111 is empty.

Discharge bin 111 is located under buffer gate 109 so that counted product from buffer bin 108 will fall by gravity into discharge bin 111. Logic unit 118 cycles discharge gate 112 with discharge gate actuator 113 upon receiving counted product from buffer bin 108 and upon an empty outfeed conveyor flight 117 properly positioned under discharge chute 114 as sensed by flight sensor 120.

Logic unit 118 provides a control signal 119 to infeed conveyor 101 control system (not shown) to stop the infeed conveyor if the receiver bin has received the counted product and receiver gate 106 is unable to cycle due to the lower bins being full of product. This case may arise if outfeed conveyor 116 should shut down or slow below the product rate of infeed conveyor 101.

Figure 2:
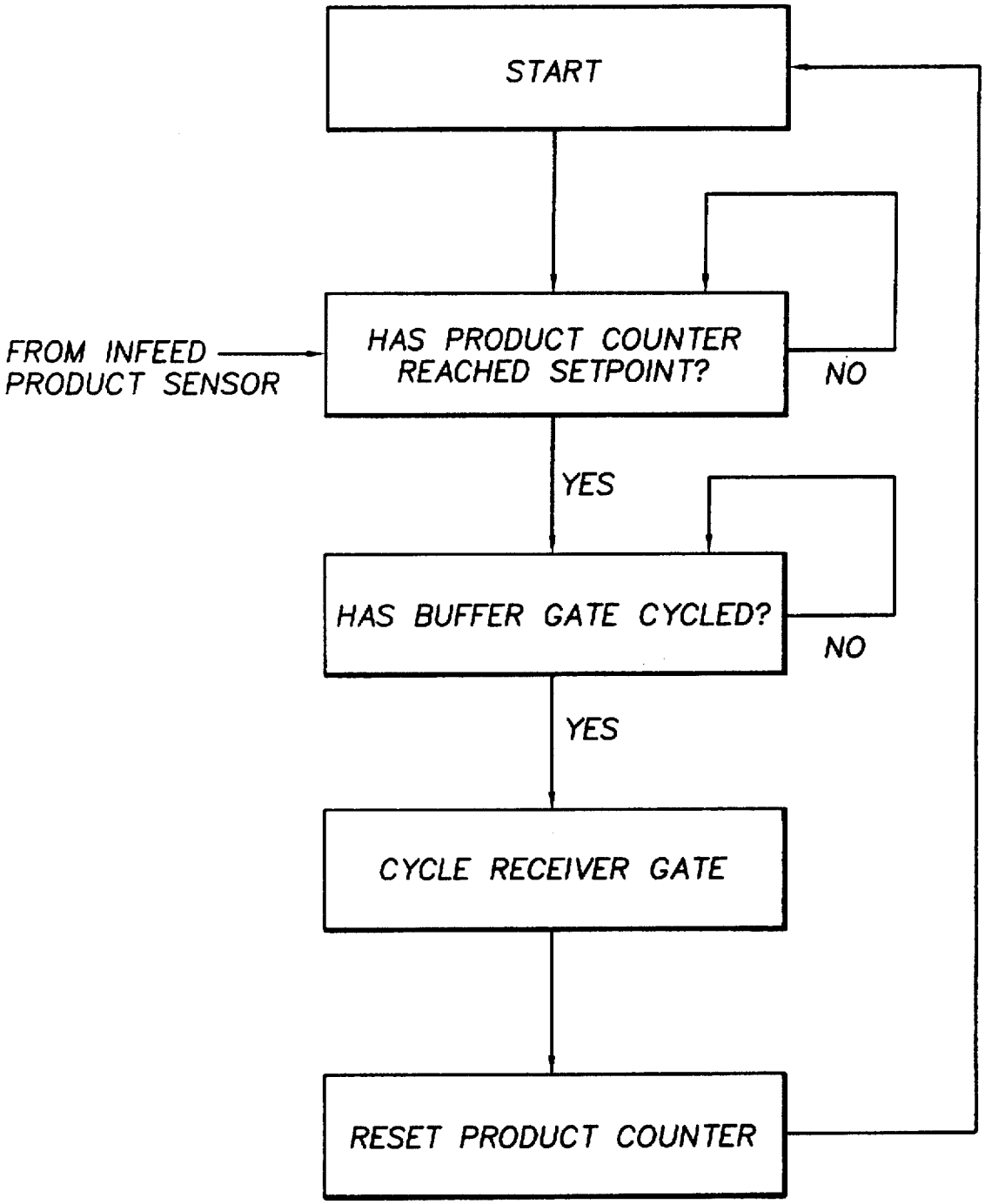
FIG. 2 is a logic diagram of the logic unit for the operation of the receiver gate of the interface unit of FIG. 1.

FIG. 2 is a logic diagram for cycling of receiver gate 106 of FIG. 1. Upon start of the logic cycle, a counter (not shown) in logic unit 118 counts product pulses from product sensor 103. Logic unit 118 cycles receiver gate 106 upon the counter reaching a predetermined product count and the buffer gate cycling, indicating the buffer bin is empty. A time delay may be added between the product counter reaching setpoint and cycling the receiver gate to ensure product counted by product sensor 118 has fully dropped into the receiver bin. Upon cycling of receiver gate 106, the product counter of logic unit 118 is reset and the logic cycle starts again. The logic requirement for buffer gate cycling in the receiver gate cycle logic may be deleted upon initial startup, since all bins are assumed to be initially empty.

Figure 3:
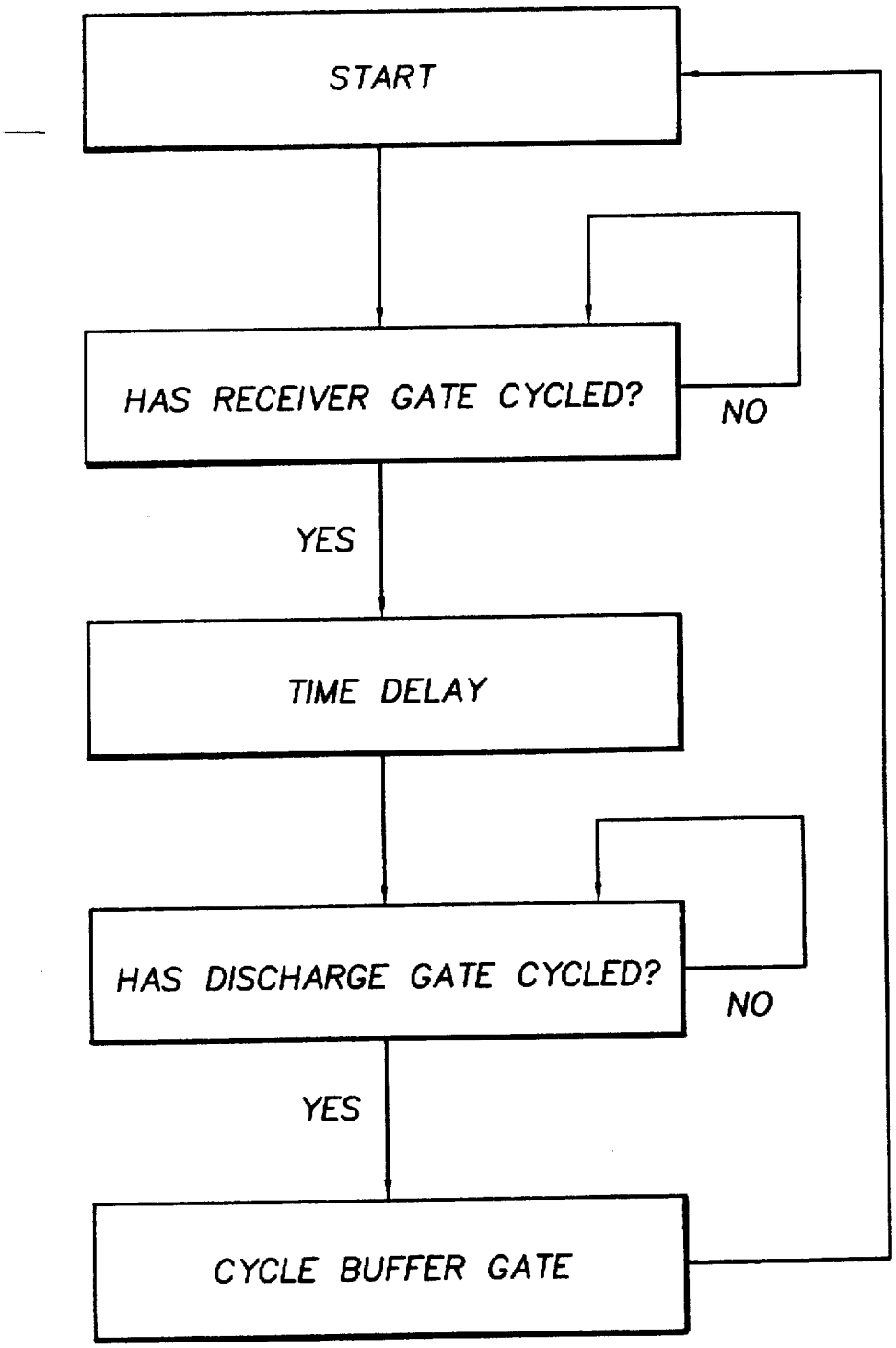
FIG. 3 is a is a logic diagram of the logic unit for the operation of the buffer gate of the interface unit of FIG. 1.

FIG. 3 is a logic diagram for cycling of buffer gate 109 of FIG. 1. Logic unit 118 cycles buffer gate 109 upon receiving product from the receiver bin (as determined by a time delay after receiver gate 106 has cycled) and upon emptying of the discharge bin (as determined by cycling of the discharge gate 109). The time delay after cycling of the receiver gate ensures that the product has had time to fall by gravity from the receiver bin to the buffer bin.

Figure 4:
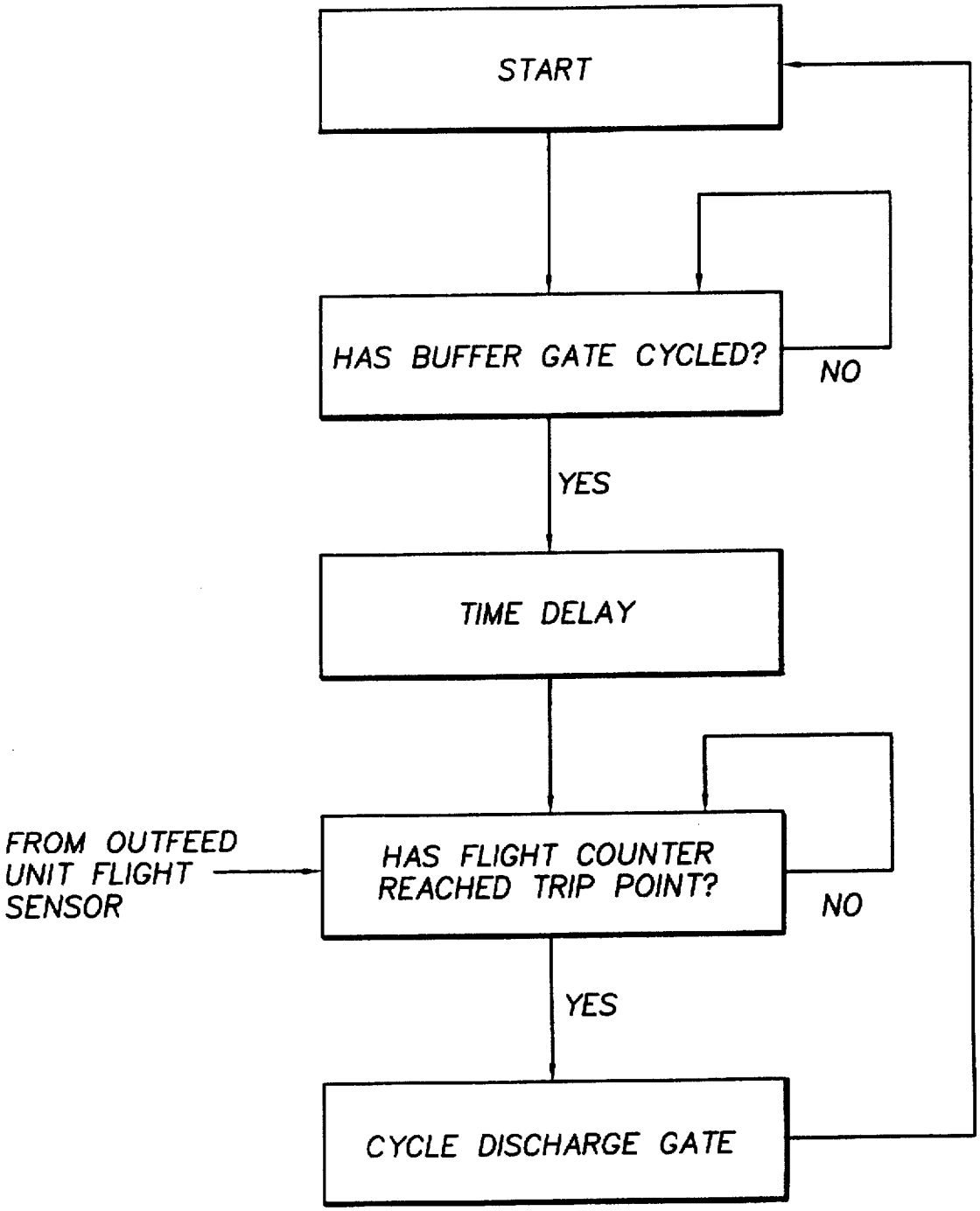
FIG. 4 is a is a logic diagram of the logic unit for the operation of the discharge gate of the interface unit of FIG. 1.

FIG. 4 is a logic diagram for cycling discharge gate 112 of FIG. 1. Logic unit 118 cycles discharge gate 112 upon receiving counted product from buffer bin 108 (as determined by a time delay after cycling of buffer gate 109) and an empty outfeed conveyor flight 117 positioned under discharge chute 114. The position of the empty flight 117 may be determined by the logic unit upon receipt of a pulse from flight sensor 120 of FIG. 1. Flight sensor 120 may be located under discharge chute 114, or at any point before discharge chute 114. Logic unit 118 may employ a time or sequence counter delay depending on the position of flight sensor 120 to account for the delay in the movement of the flight of the outfeed conveyor from the flight sensor to the discharge chute. Logic unit 118 may also be programmed to account for the time delay required for counted product to fall from discharge bin 111 to flight 117.

Buffer bin 108 allows temporary mismatching of the product feed rate of infeed conveyor 101 and outfeed conveyor 116 of FIG. 1. This mismatch may occur due to use of separate controllers for the infeed unit and the outfeed unit, or it may occur due to intermittent slowing or stopping of either unit. Elimination of buffer bin 108 would result in inconsistent product delivery between the infeed unit and the outfeed unit if small differences in controller timing or sequencing occurred. Additional buffer bins may be added to provide additional product storage. Additional product storage increases the ability of the unit to accommodate temporary differences in product rate between the infeed and outfeed units.

Figure 5:
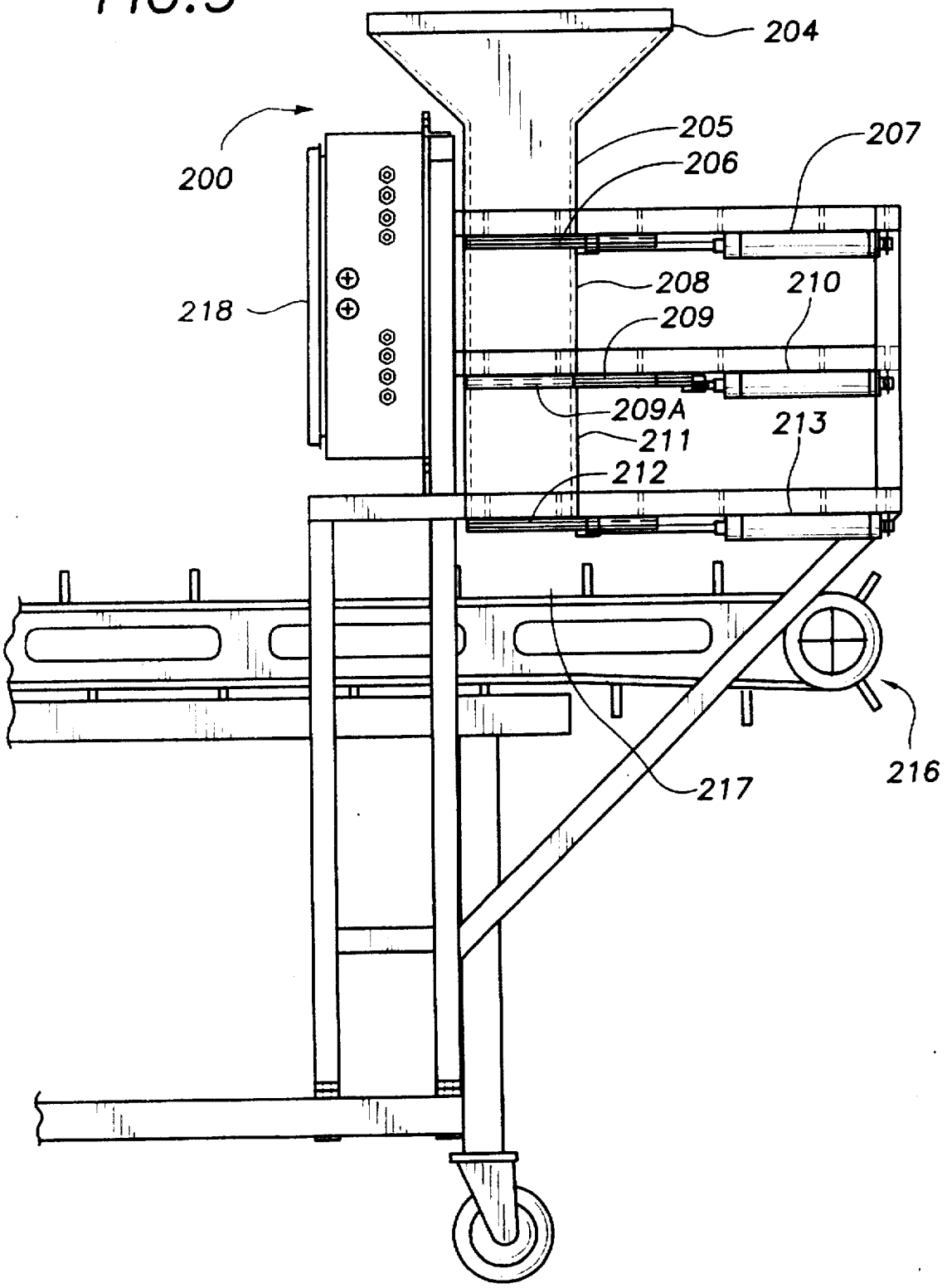
FIG. 5 is side elevation drawing of the interface device showing an outfeed conveyor positioned to receive the counted product from the discharge gate of the device.

FIG. 5 is a side elevation drawing of embodiment 200 the interface device. Receiver chute 204 guides product (not shown) into receiver bin 205. Receiver gate 206 is actuated by receiver cylinder 207. Buffer bin 208 is positioned directly below receiver gate 206 and receives product by gravity from receiver bin 205 when receiver gate 206 is cycled. Buffer gate 209 is shown in the open position and is actuated by cylinder 210. Discharge bin 211 is located directly under buffer gate chute 209A to receive product by gravity from buffer bin 208. Discharge gate 212 is actuated by cylinder 213. Flight 217 of outfeed conveyor 216 is located below discharge gate 212 to receive counted product by gravity from discharge bin 211. Control unit 218 contains the logic unit and signal conditioning equipment for cylinders 207, 210 and 213.

Accordingly the reader will see that the INTERFACE UNIT FOR PACHAGING EQUIPMENT provides an interface between product infeed units and product outfeed units. The device provides the following additional advantages:

- The device allows differences in product rates between the infeed unit and the outfeed unit;
- No connection to the control system of the outfeed unit is required;
- The device provides a programmable product counting and grouping function; and
- The device is portable and simple to use.

Although the description above contains many specifications, these should not be construed as limiting the scope of the invention but as merely providing illustrations of some of the presently preferred embodiments of this invention. For example, the logic unit may be modified to utilize additional product sensors in the bins, etc. Thus the scope of the invention should be determined by the appended claims and their legal equivalents, rather than by the examples given.

We claim:

1. An interface device for packaging equipment, the device receiving a product from an infeed unit and discharging the product to an outfeed unit, the device comprising:

a receiver bin comprising a receiver gate disposed at the bottom of the receiver bin;

a buffer bin positioned under the receiver gate whereby a product released by the receiver gate will drop into the buffer bin by gravity, the buffer bin comprising a buffer gate disposed at the bottom of the buffer bin;

a discharge bin positioned under the buffer gate whereby a product released by the buffer gate will drop into the discharge bin by gravity, the discharge bin comprising a discharge gate disposed at the bottom of the discharge bin;

a product sensor disposed to sense product between the infeed unit, inclusive, and the receiver gate;

a flight sensor disposed to sense the position of a product carrying element on the outfeed unit; and a logic unit connected to the product sensor and the flight sensor, the logic unit comprising a counter, the logic unit cycling the receiver gate upon a predetermined product count received from the product sensor, cycling the buffer gate upon a predetermined logic condition, and cycling the discharge gate upon a predetermined position of the product carrying element of the outfeed unit.

2. The interface device of claim 1 wherein the predetermined logic condition comprises the cycling of the receiver gate.

3. The interface device of claim 1 wherein the predetermined logic condition comprises the cycling of the receiver gate and a cycling of the discharge gate.

4. The interface device of claim 1 wherein the logic unit comprises a timer and the predetermined logic condition comprises cycling of the receiver gate, a predetermined time delay after the receiver gate has cycled, and a cycling of the discharge gate.

* * * * *